US006123653A

United States Patent [19]

Huang

[11] Patent Number: 6,123,653

[45] Date of Patent: Sep. 26, 2000

[54] MULTIFUNCTIONAL SITUP EXERCISER

[75] Inventor: Don Huang, 10Fl., No. 28, Wen-Chung Rd., Kaohsiung Hsien, Taiwan

[73] Assignees: Don Huang, Changhua Hsien; Longer Enterprise Co. L, Kaohsiung, both of Taiwan

[21] Appl. No.: 09/229,624

[22] Filed: Jan. 13, 1999

[51] Int. Cl.[7] ..... A63B 26/00

[52] U.S. Cl. ..... 482/142; 482/140

[58] Field of Search ..... 482/142, 140, 482/145, 4, 123, 95, 72, 133, 138, 115, 126, 127

[56] References Cited

U.S. PATENT DOCUMENTS 5,176,603 1/1993 Hundley et al. ..... 482/140

5,308,306 5/1994 Wang ..... 482/142

*Primary Examiner*—Michael A. Brown

*Assistant Examiner*—Lori Baker

*Attorney, Agent, or Firm*—Browdy and Neimark

[57] ABSTRACT

A multifunctional situp exerciser including a reverse T-shaped inclined main frame which is adjustable in length and a front and a rear beam pivotally connected with a middle upper section of the main frame by a pivot device to form a substantially L-shaped pattern. An upper end and a middle section of the main frame are respectively connected with two transverse soft stopper arms projecting leftward and rightward. A front rest pad is fixed on top face of the front beam. A locating device is disposed at rear end of bottom face of the front beam. A relative small diameter fitting bar formed with several locating holes extends forward from the interior of the rear beam. The fitting bar is fitted in the rear section of the front beam and located by the locating device which is inserted into the locating hole. A shorter rear rest pad and three movably rotatable massage rods are pivotally disposed on top face of the rear beam. Two arch rocking arms which are adjustable in angle are pivotally disposed on bottom face of the rear beam. The rocking arms are rotatably fixed to the rest pad, whereby during exercising, a massaging effect is produced the exercising manners are variable.

2 Claims, 5 Drawing Sheets

MULTIFUNCTIONAL SITUP EXERCISER

BACKGROUND OF THE INVENTION

The present invention relates to a multifunctional situp exerciser additionally including three movably rotatable massage rods, whereby during exercising, a massaging effect is produced. In addition, the angle of two arch rocking arms is adjustable as necessary so as to vary the exercising manners and achieve more exercising effect and fun.

PRIOR ART

A conventional situp exerciser includes a reverse T-shaped inclined main frame which is adjustable in length and a front and a rear beam pivotally connected with a middle upper section of the main frame by a pivot device to form a substantially L-shaped pattern. An upper end and a middle section of the main frame are respectively connected with two transverse soft stopper arms projecting leftward and rightward for a user's ankles and knees to lean thereon. A front rest pad is fixed on a top face of the front beam. A locating device is disposed at rear end of bottom face of the front beam. The above situp exerciser is characterized in that a relative small diameter fitting bar formed with several locating holes extends forward from the interior of the rear beam. The fitting bar is fitted in the rear section of the front beam and located by the locating device which is inserted into the locating hole. A front section of the rear beam is connected with a transverse shaft core. A middle section of the rear beam is welded with a transverse shaft rod. A left and a right sections of the shaft core are respectively pivotally fitted with two sleeves which extend transversely inward toward each other from front ends of two parallel support members fixed on two sides of the bottom face of a shorter rear rest pad. Each sleeve is welded with a swinging vane. A left and a right sections of the shaft rod are respectively pivotally fitted with two fitting tubes. Each fitting tube is welded with an activating plate and an end of an upward curved arch rocking arm. The activating plate is pivotally connected with the swinging vane by a linking plate. In use, a user can hold the head sections of the rocking arms with both hands and forceably turn the same upward so as to lift the rear rest pad. Accordingly, the situp exerciser can be adjusted and folded and the exercising manners can be varied to achieve multiple functions.

In addition, the rear and front rest pads are connected with each other by a leather skin.

SUMMARY OF THE INVENTION

It is a primary object of the present invention to provide a multifunctional situp exerciser in which the rear rest pad is shortened and three movably rotatable massage rods are added to the rear side of the rear rest pad, whereby during exercising, a massaging effect is also achieved.

It is a further object of the present invention to provide the above situp exerciser in which the angle of two arch rocking arms is adjustable as necessary so as to vary the exercising manners and achieve more exercising effect and fun.

The present invention can be best understood through the following description and accompanying drawings, wherein:

DETAILED DESCRIPTION OF THE PREFERRED EMBODIMENT

Figure 1:
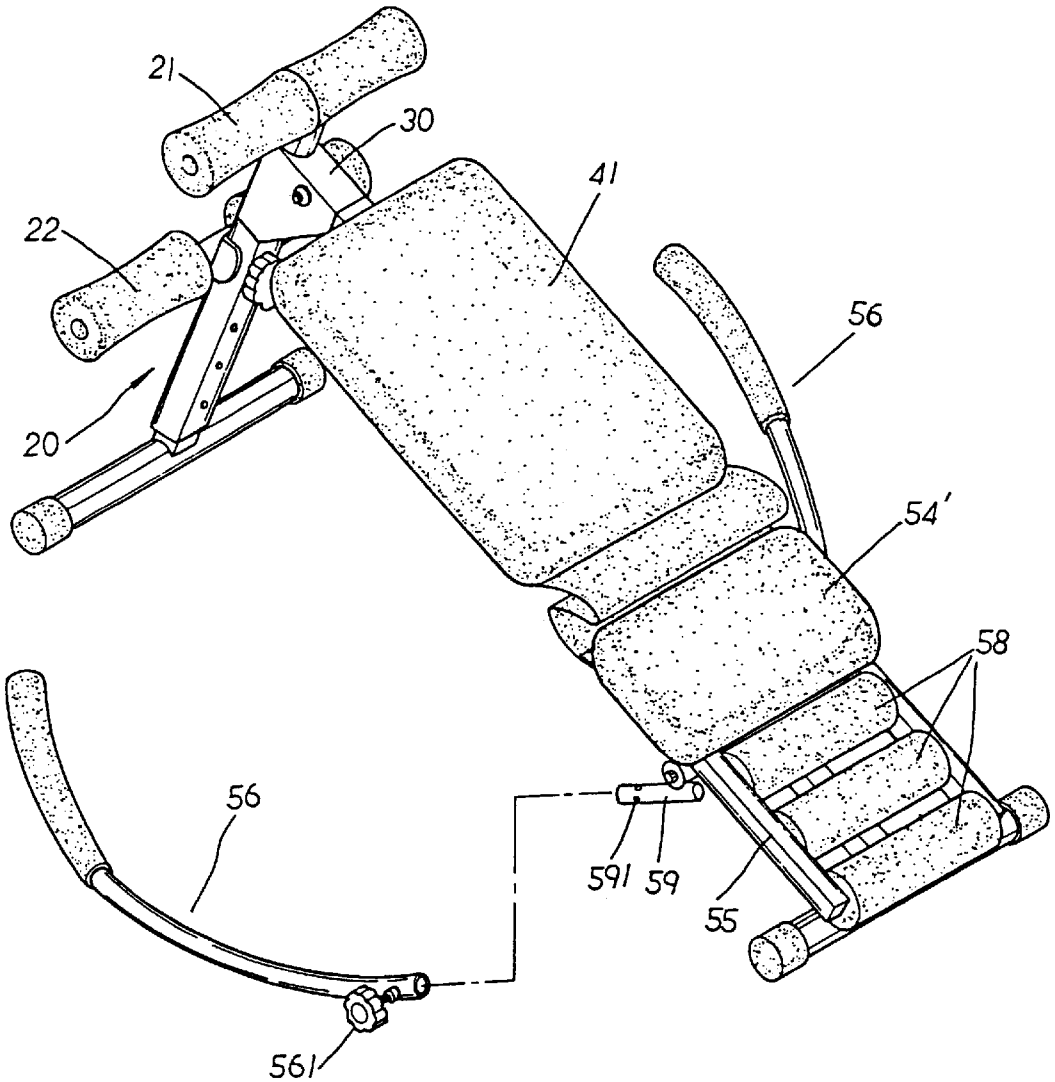
FIG. 1 is a perspective view of the present invention.
Figure 2:
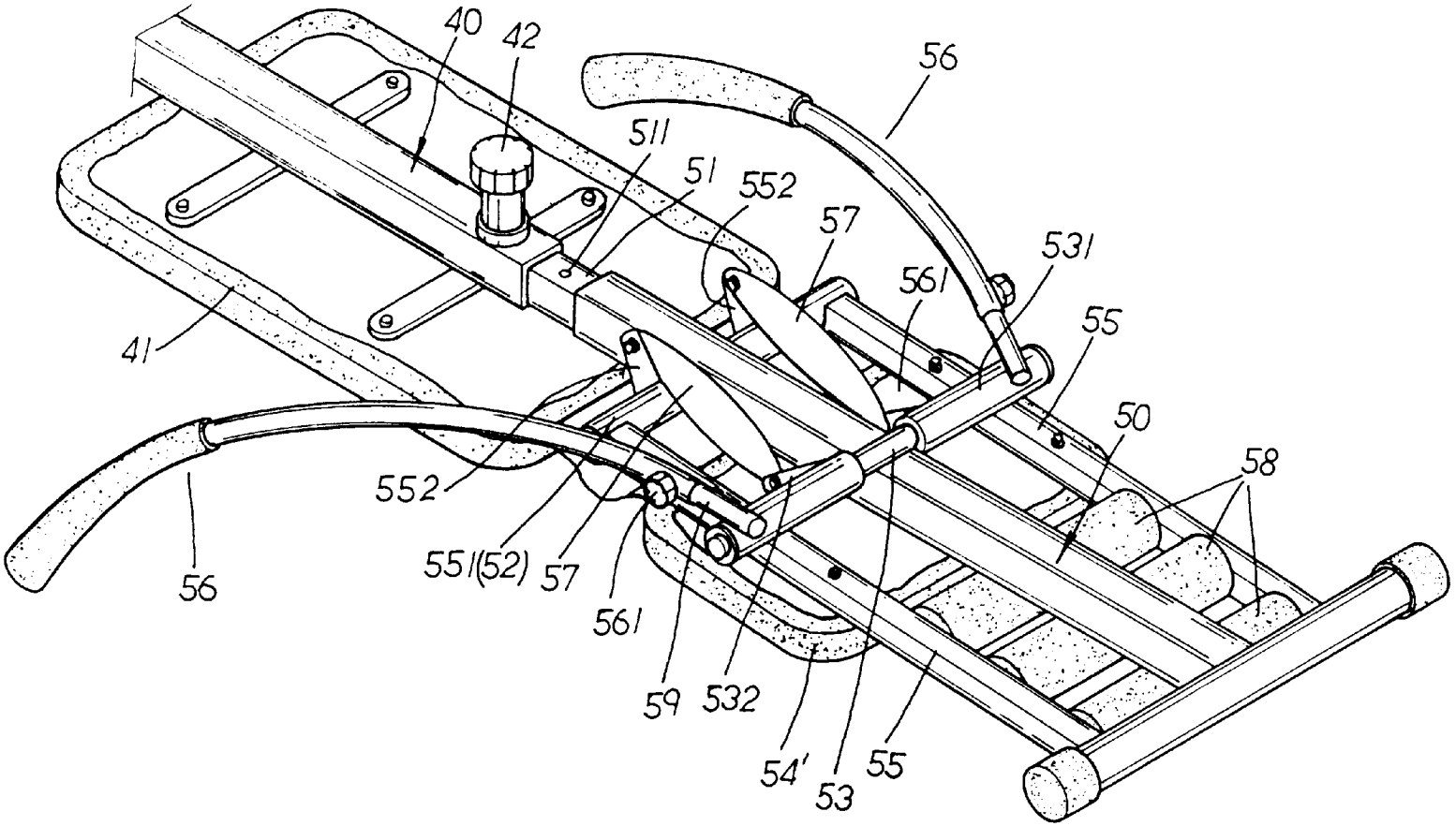
FIG. 2 is a perspective view of the present invention, showing the back face thereof.

Please refer to FIGS. 1 and 2. The present invention includes a reverse T-shaped inclined main frame 20 which is adjustable in length and a front and a rear beams 40, 50 pivotally connected with a middle upper section of the main frame 20 by a pivot device 30 to form a substantially L-shaped pattern. An upper end and a middle section of the main frame 20 are respectively connected with two transverse soft stopper arms 21, 22 projecting leftward and rightward. A front rest pad 41 is fixed on top face of the front beam 40. A locating device 42 is disposed at rear end of bottom face of the front beam 40. A fitting bar 51 having a cross-section smaller than that of front beam 40 and rear beam 50 is formed with several locating holes 511 extends forward from the interior of the rear beam 50. The fitting bar 51 is fitted in the rear section of the front beam 40 and located by the locating device 42 which is inserted into the locating hole 511. A front section of the rear beam 50 is connected with a transverse shaft core 52 projecting leftward and rightward. A middle section of the rear beam is welded with a transverse shaft rod 53. The left and right sections of the shaft core 52 are respectively pivotally fitted with two sleeves 551 which extend transversely inward toward each other from front ends of two parallel support members 55 fixed on two sides of bottom face of a shorter rear rest pad 54'. The rear and front rest pads 54', 41 are connected with each other by a leather skin in cooperation with male and female fastening tapes. A rear side of the rear rest pad 54' is disposed with three movably rotatable massage rods 58 between the two parallel support members 55. Each sleeve 551 is welded with a swinging vane 552. The left and right sections of the shaft rod 53 are respectively pivotally fitted with two fitting tubes 531. Each fitting tube 531 is welded with an activating plate 532 and a fitting rod 59 formed with locating holes 591 of different angles. The activating plate 532 is pivotally connected with the swinging vane 552 by a linking plate 57. An end of an upward curved arch rocking arm 56 is fitted with the fitting rod 59. A bolt 561 is screwed into the locating hole 591 of the fitting rod 59 to locate and fix the rocking arm.

Figure 3B:
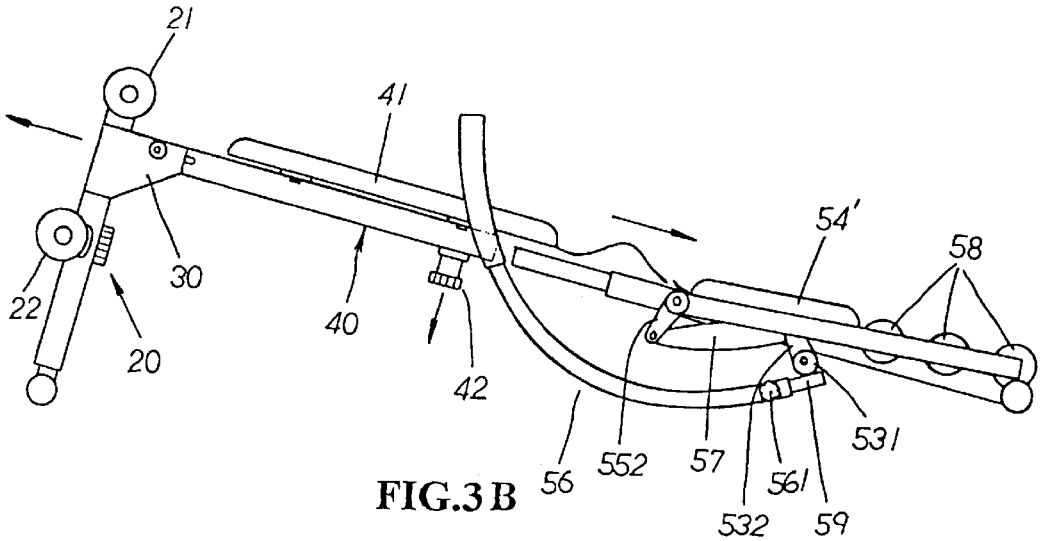
FIG. 3B is an extended state of the invention according to FIG. 3A.
Figure 3A:
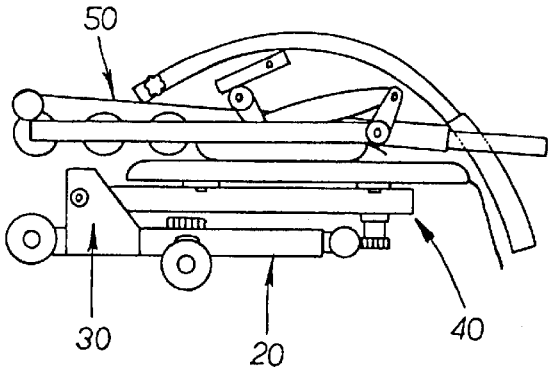
FIG. 3A shows a folded state of the present invention.

FIG. 3 shows the folded state of the present invention. When folded, the main frame 20 together with the pivot device 30 is pulled slightly forward and the locating device 42 at rear end of the front beam 40 is pulled downward. The locating device 42 is disengaged from the locating hole 511 of the fitting bar 51 so as to separate the rear beam 50 from the front beam 40. At this time, the main frame 20 together with the pivot device 30 is folded toward the bottom face of the front beam 40 and the rear beam 50 is folded toward the top face of the front beam 40 so as to reduce the volume of the exerciser.

Figure 4:
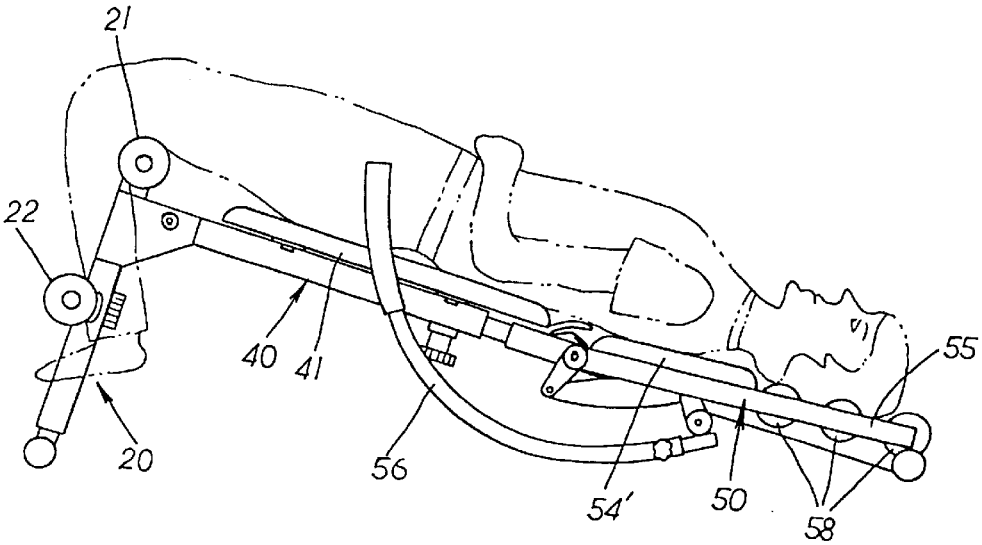
FIG. 4 shows a first application of the present invention.
Figure 5:
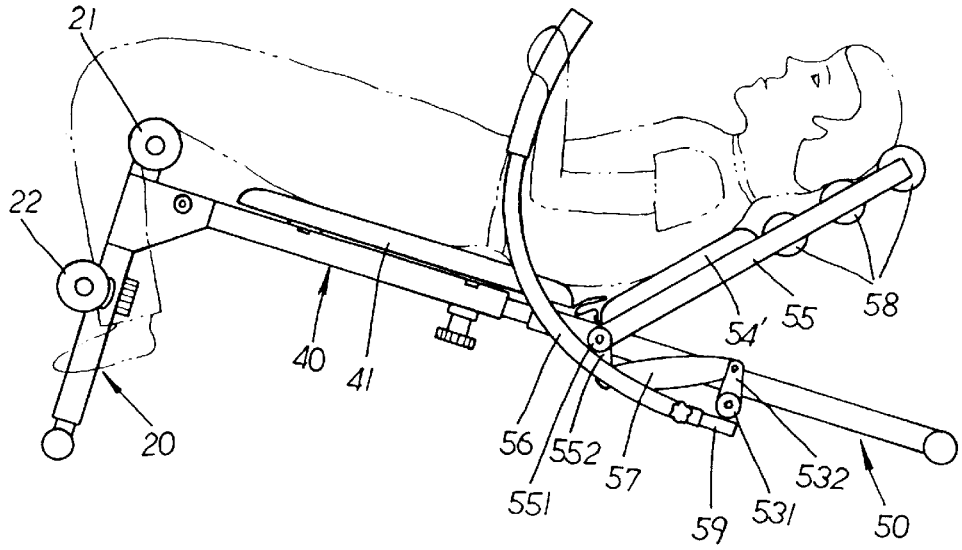
FIG. 5 shows a second application of the present invention.

FIG. 4 shows a first application of the present invention. The ankles and knees of a user lean on the transverse stopper arms 21, 22 at upper end and middle section of the main frame 20. The body of the user lies on the front and rear rest pads 41, 54' and the three massage rods 58 to directly exercise the body by situp. Also, at the same time of situp, the user can hold the head sections of the arch rocking arms 56 with both hands and forceably turn the rocking arms upward (referring to FIG. 5 of the second application of the present invention). Accordingly, the tail ends of the rocking arms 56 drive the fitting tubes 531 and the activating plates 532. At this time, via the two linking plates 57, the activating plates 532 drive the two swinging vanes 552 which via the sleeves 551 drive the support members 55 on bottom face of the rear rest pad 54' so as to make the rear rest pad 54' and the three massage rods 58 lift the user's head. This makes it easier to perform the situp exercise (and suitable for those users with less strength, such as females, children, etc.).

Figure 6:
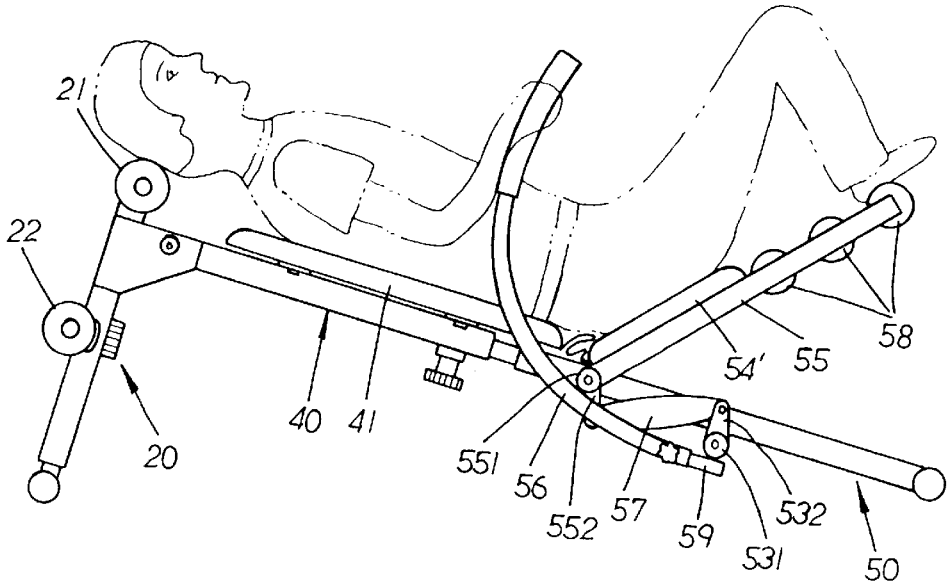
FIG. 6 shows a third application of the present invention.

FIG. 6 shows a third application of the present invention. In addition to the situp exercise, the user's head can be rested on the transverse stopper arms 21 of the upper end of the main frame 20 with the body reversely lying on the front and rear rest pads 41, 54'. The knees are properly bent to make the soles step on the rearmost massage rod 58. Both hands hold the head sections of the rocking arms 56 to turn the same upward. Accordingly, the tail ends of the rocking arms 56 drive the fitting tubes 531 and the activating plates 532. At this time, via the two linking plates 57, the activating plates 532 drive the two swinging vanes 552 which via the sleeves 551 drive the support members 55 on bottom face of the rear rest pad 54' so as to make the rear rest pad 54' lift the user's hip. Also, the rearmost massage rod 58 lifts the user's feet so as to exercise the user's abdomen.

Figure 7:
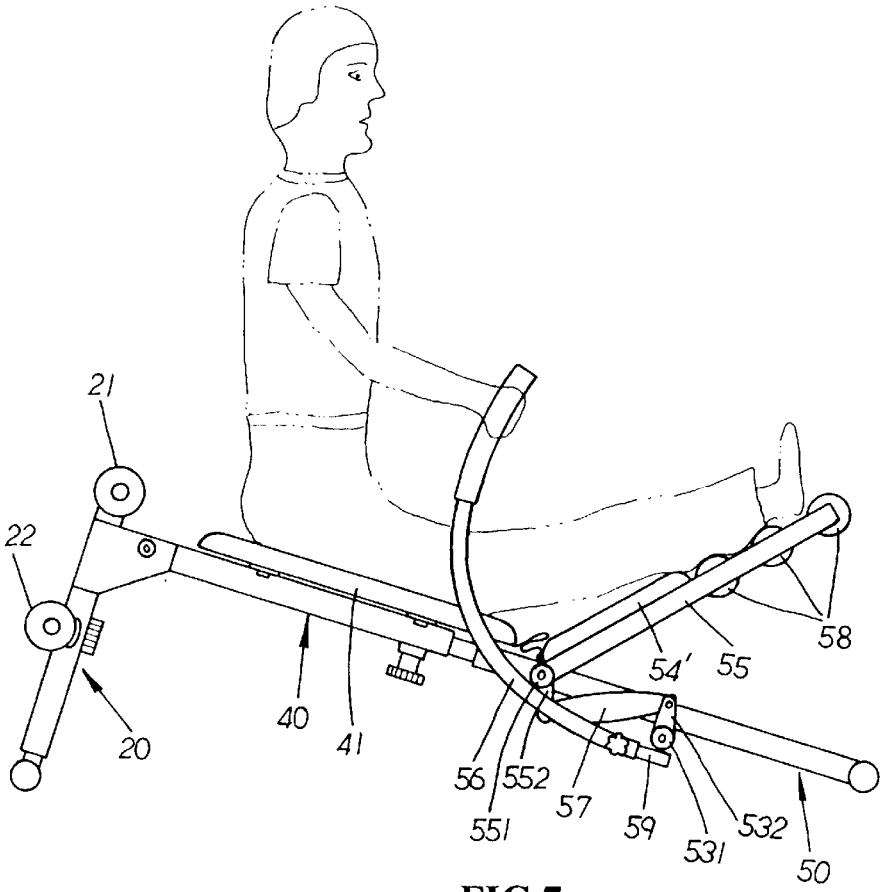
FIG. 7 shows a fourth application of the present invention.

FIG. 7 shows a fourth application of the present invention. A user can sit on the front rest pad 41 with his/her legs resting on the rear rest pad 54' and the three massage rods 58. Both hands of the user hold the head sections of the rocking arms 56 to turn the same upward. Accordingly, the tail ends of the rocking arms 56 drive the fitting tubes 531 and the activating plates 532. At this time, via the two linking plates 57, the activating plates 532 drive the two swinging vanes 552 which via the sleeves 551 drive the support members 55 on bottom face of the rear rest pad 54' so as to make the rear rest pad 54' and the three massage rods 58 lift the user's legs so as to exercise the user's legs.

Figure 8:
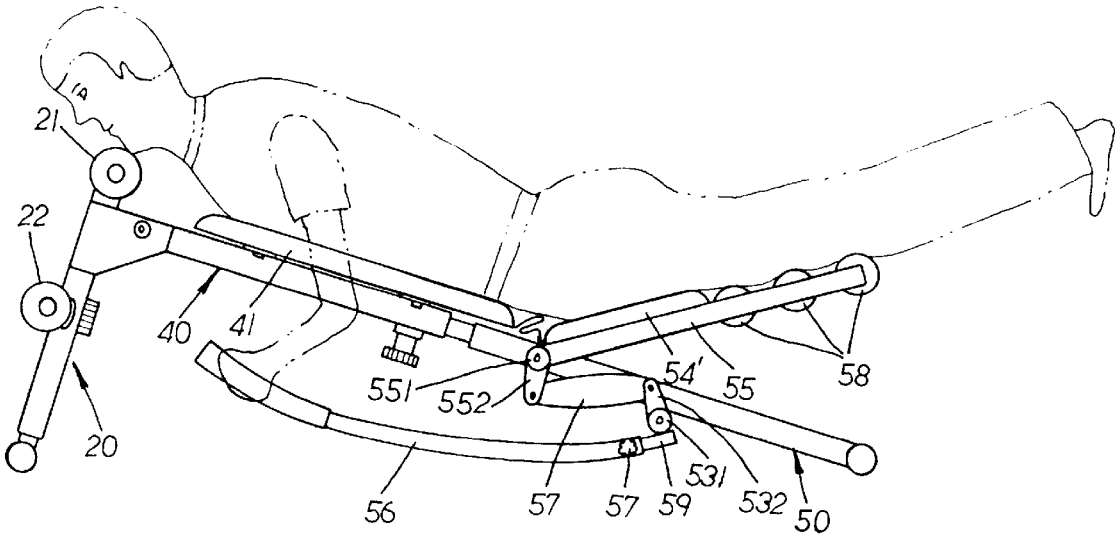
FIG. 8 shows a fifth application of the present invention.

FIG. 8 shows a fifth application of the present invention. The two arch rocking arms 56 can be adjusted into a horizontal state, whereby the user can attach his/her face onto the transverse stopper arms 21 of the upper end of the main frame 20 with his/her body reversely lying on the front and rear rest pads 41, 54' and the three massage rods 58. Both hands of the user hold the head sections of the rocking arms 56 to turn the same upward. Accordingly, the tail ends of the rocking arms 56 drive the fitting tubes 531 and the activating plates 532. At this time, via the two linking plates 57, the activating plates 532 drive the two swinging vanes 552 which via the sleeves 551 drive the support members 55 on bottom face of the rear rest pad 54' so as to make the rear rest pad 54' and the three massage rods 58 lift the user's legs so as to exercise the user's hip.

According to the above arrangements, the present invention has the following advantages:

1. During exercising, the three massage rods 58 produce a massaging effect.

2. The angle of the rocking arms 56 can be adjusted so as to vary the exercising manners and achieve more effect and fun.

It is to be understood that the above description and drawings are only used for illustrating one embodiment of the present invention, not intended to limit the scope thereof. Any variation and derivation from the above description and drawings should be included in the scope of the present invention.

What is claimed is:

1. A multifunctional situp exerciser comprising a reverse T-shaped inclined main frame which is adjustable in length and a front and a rear beam pivotally connected with a middle upper section of the main frame by a pivot device to form a substantially L-shaped pattern, an upper end and a middle section of the main frame being respectively connected with two transverse soft stopper arms projecting leftward and rightward, a front rest pad being fixed on top face of the front beam, a locating device being disposed at rear end of bottom face of the front beam, a fitting bar formed with several locating holes extending forward from the interior of the rear beam, the fitting bar being fitted in the rear section of the front beam and located by the locating device which is inserted into the locating hole, a front section of the rear beam being connected with a transverse shaft core projecting leftward and rightward, a middle section of the rear beam being welded with a transverse shaft rod, a left and a right sections of the shaft core being respectively pivotally fitted with two sleeves which extend transversely inward toward each other from front ends of two parallel support members fixed on two sides of bottom face of a shorter rear rest pad, each sleeve being welded with a swinging vane, a left and a right section of the shaft rod being respectively pivotally fitted with two fitting tubes, each fitting tube being welded with an activating plate pivotally connected with the swinging vane by a linking plate, said situp exerciser being characterized in that the rear rest pad is pivotally connected with the top face of front section of the rear beam, three movably rotatable massage rods being disposed on rear side of the rear rest pad between the two parallel support members, each fitting tube being welded with a fitting rod formed with locating holes of different angles, an end of an upward curved arch rocking arm being fitted with the fitting rod, a bolt being screwed into the locating hole of the fitting rod to locate and fix the rocking arm.

2. A situp exerciser as claimed in claim 1, wherein the rear and front rest pads are connected with each other by a leather skin in cooperation with male and female fastening tapes.

* * * * *